US005303494A

United States Patent [19]

Tuma et al.

[11] Patent Number: 5,303,494

[45] Date of Patent: Apr. 19, 1994

[54] HANDGUN HAVING A DECOCKING/SAFETY CONTROL DEVICE

[76] Inventors: Martin Tuma, Allmendstrasse 31 B, CH-4503 Solothurn; Vaclav Brunclik, Lättenstrasse 106, CH-8142 Uitikon, both of Switzerland

[21] Appl. No.: 947,511

[22] Filed: Sep. 17, 1992

[30] Foreign Application Priority Data

Jul. 20, 1992 [EP] European Pat. Off. ..... 92112406

[51] Int. Cl.[5] ..... F41A 17/62

[52] U.S. Cl. ..... 42/70.04; 42/69.03; 89/148

[58] Field of Search ..... 42/69.03, 70.04, 70.05, 42/70.08; 89/148

[56] References Cited

U.S. PATENT DOCUMENTS

| | | | |
|---|---|---|---|
| 3,824,728 | 7/1974 | Kennedy | 42/66 |
| 4,589,327 | 5/1986 | Smith | 89/148 |
| 5,086,579 | 2/1992 | Flatley | 42/70.08 |
| 5,088,222 | 2/1992 | Larson | 421/70.04 |
| 5,212,327 | 5/1993 | Schuemann | 89/148 |

FOREIGN PATENT DOCUMENTS

| | | |
|---|---|---|
| 3130963 | 3/1983 | Fed. Rep. of Germany . |
| 3808102 | 10/1989 | Fed. Rep. of Germany . |
| 533076 | 2/1922 | France . |
| 2380526 | 9/1978 | France . |
| 2407450 | 5/1979 | France . |
| 100187 | 10/1916 | United Kingdom . |

*Primary Examiner*—Stephen C. Bentley
*Attorney, Agent, or Firm*—Ladas & Parry

[57] ABSTRACT

A rotatable shaft member supports a first control member and a second control member. The first control member cooperates with a tang of a rotatable sear. The second control member cooperates with an abutment stop of the sear. When the shaft is rotated to where the second control member contacts the abutment stop of the sear, the sear is blocked and the gun cannot be fired. When the shaft member is rotated such that the second control member is moved away from the tang of the sear, the gun can be fired. When the shaft member is rotated further such that the second control member is remote from the abutment stop and the first control member contacts the tang of the sear, the tang moves out of contact with the searing surface of the hammer. The hammer begins to pivot in a gun firing direction until the tang engages a half-cocked notch for stopping movement of the hammer, whereby the hammer is decocked.

5 Claims, 5 Drawing Sheets

HANDGUN HAVING A DECOCKING/SAFETY CONTROL DEVICE

BACKGROUND OF THE INVENTION

1. Field of the Invention

The invention relates to a handgun, having a frame, a firing pin, a barrel mounted thereupon, a slide for sliding reciprocating movement on said frame, a trigger pivotally mounted upon the frame by a trigger pin, a trigger rod member pivotally connected to the trigger by means of a pin and having a control surface, a spring loaded sear pivotally mounted upon the frame by means of a sear pin, a hammer pivotally mounted to the frame by means of a hammer pin, a hammer spring acting onto the hammer, which hammer includes a searing surface and a half-cocked notch, which sear includes a tang for engaging the searing surface of the hammer, and includes a control projection for engaging the control surface of the trigger rod member, which sear is rotatable between a hammer locking position and a hammer release position.

2. Description of the Prior Art

Such guns are generally known as semiautomatic pistols which can be fired in a single action mode and in a double action mode, as well.

Such guns should lend themselves to be fired quickly and accurately. Further, they should lend themselves for a safe operation because faulty manipulations, for instance, under stress can lead to an accidental firing of the gun. Such an accidental firing of the gun due to a faulty manipulation can occur when decocking the gun. A decocking of a cocked gun is accomplished generally, in that the operator pulls the trigger slightly and simultaneously holds the hammer with his thumb to slowly move the hammer into the decocked position. The hammer can slip off the thumb such that accidentally a shot is fired. It is also desirable to have a gun which can be operated easily to establish various states such as safety on, safety off and decocking.

SUMMARY OF THE INVENTION

It is a general object of the present invention to provide a handgun having a decocking lever device capable to be operated at either side of the gun and operable by the thumb of the shooting hand, and operable into the safety-off state by a depressing movement, which hand gun can not be locked in its decocked state, which lever device shall not function decocking when the gun is in its locked state, and which decocking lever shall be operable to lower the hammer to return the pistol to the safe-carry condition, all in accordance with the joint-service operational requirement (JSOR) established by the US Special Operations Command (USSOCOM).

A further object is to provide a handgun having a pivotable decocking/safety control device supported at the frame by means of a control device shaft member and having a first control member adapted to cooperate with the sear and the hammer for a decocking of the gun, and a second control member adapted to cooperate with the sear for locking the gun.

Yet a further object is to provide a handgun, in which the first control member is arranged for a movement into and out of contact with the tang of the sear, which sear includes further an abutment stop for engaging the second control member of the decocking safety control device, which decocking/safety control device is rotatable between a safety position, a firing position and a decocking position; whereby in the safety position of the decocking/safety control device its second control member contacts the abutment stop of the sear in its hammer locking position and prevents a movement thereof into its hammer release position; in the firing position of the decocking/safety control device its second control member is at a distance from the abutment stop of the sear allowing a trigger rod member initiated movement thereof into the hammer release position; in the decocking position of the decocking/safety control device its second control member is at a distance from the abutment stop of the sear and its first control member contacts the tang of the sear to urge it away from the path of movement of the searing surface of the hammer and into the path of movement of the half-cock notch of the hammer preventing the latter from snapping against the firing pin.

The advantage offered by the invention is mainly that the hammer can be locked in its firing position and be safely decocked by one and the same operating device facilitating the operation of the gun; a simple pivoting movement of the control device allows an automatic decocking of the hammer independently from the mental state of the operator.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
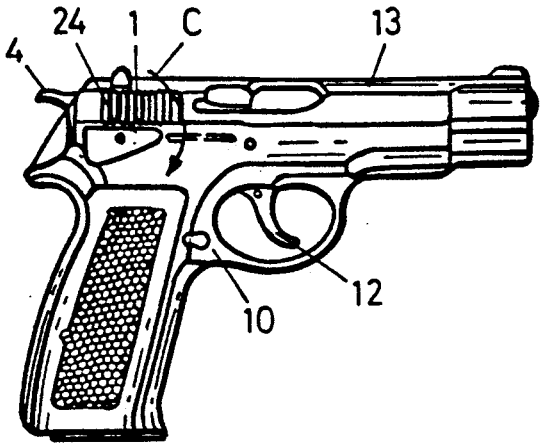
FIG. 1 is a side view of a semiautomatic pistol structured in accordance with the present invention, FIG. 2, on a somewhat enlarged scale, is a side view of the decocking/safety control device.

FIG. 1 illustrates a semiautomatic pistol having a decocking/safety control device structured in accordance with the present invention. The semiautomatic pistol illustrated in FIG. 1 includes a frame 10, a trigger 12, a slide 13 mounted for reciprocating movement on the frame 10 and a hammer 4. Reference numeral 1 denotes an operating lever of the decocking/safety control device visible in FIG. 1 in form approximately as a rectangular triangle. The operating lever 1 can be depressed by means e.g. of the thumb to rotate in the direction of the arrow C in FIG. 1. It can, thereby, be moved between three positions. The resting in any of these positions can be accomplished, for instance, by a notch as obvious for the person skilled in the art. FIG.

Figure 2:
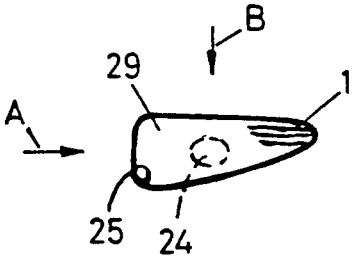
Figure 3:
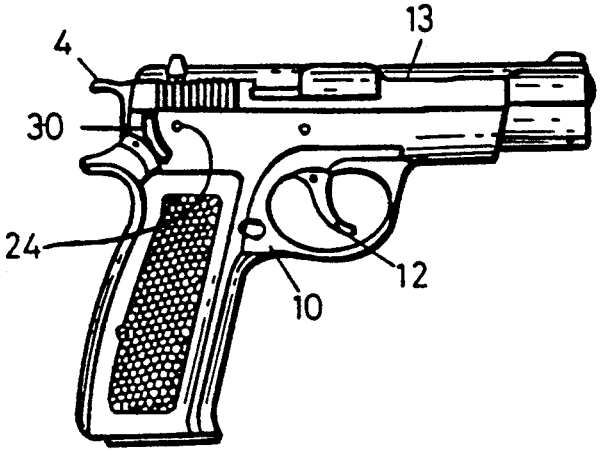
FIG. 3 is a view similar to FIG. 1 with the decocking-/safety control device partly removed.

2 illustrates on a somewhat enlarged scale the operating lever 1 of FIG. 1. It can be rotated around a shaft member 24, of which the central line is also illustrated in FIG. 1. When the lever 1 is depressed in direction of the arrow C, the oppositely located arm 29 moves upwards due to the rotation around the shaft member 24. Also illustrated in FIG. 2 is the location of a first control member 25 (on the side of the arm 29 facing away from the viewer) which will be explained more in detail further below. This first control member 25 has a peg like shape and projects from the arm 29 into the inside of the frame 10. Accordingly, such as illustrated in FIG. 3, the frame 10 includes a curvilinear slot 30, through which slot the peg-shaped first control member projects into the inside of the frame 10. Reference numeral 24 in FIG. 3 illustrates the location of the shaft member, i.e. the location of its center axis, around which the operating lever 1 and arm 29, respectively, may be rotated.

Figure 4:
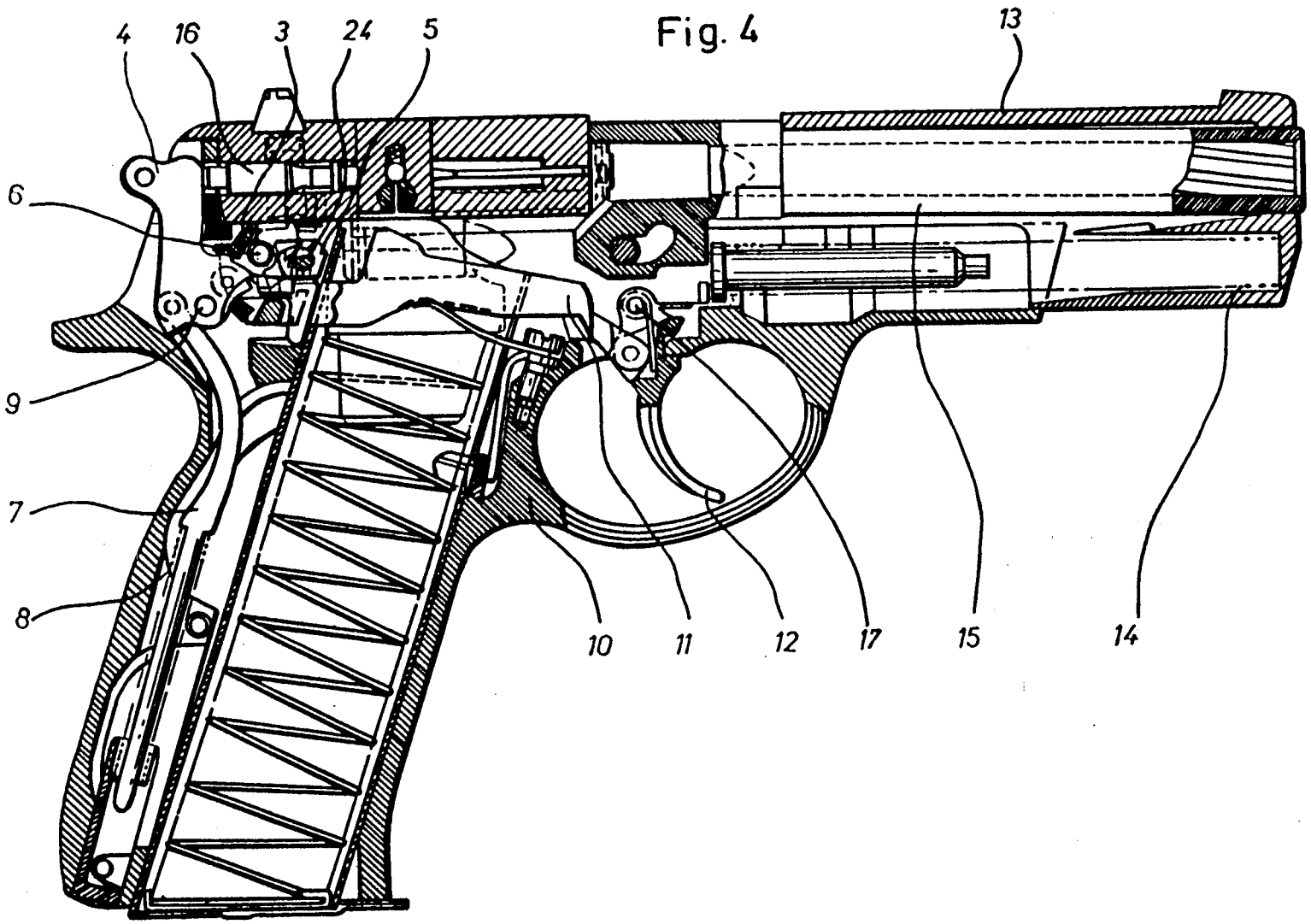
FIG. 4 is a section through a semiautomatic pistol including an embodiment of the present invention.

The pistol or handgun, respectively, as illustrated in FIG. 4, has a frame 10, a barrel 15 mounted on the frame, a slide 13 mounted for sliding reciprocating movement on the frame 10 and a recoil spring 14. A trigger 12 is pivotally mounted upon the frame 10 by a trigger pin 17 (see hereto also FIG. 7). A trigger rod member 11 is pivotally connected to the trigger 12 by means of a pin 18.

The pistol as designed in FIG. 4 includes, furthermore, a sear 3, hammer 4, ejector 5 and firing pin 16. Reference numeral 6 identifies the sear pin, around which the sear 3 rotates. The hammer 4 is pivotally connected to a hammer rod 7 subjected to the biassing force of the hammer spring 8. The hammer 4 is pivotally mounted to the frame by means of the hammer pin 9.

This structural elements are generally known and in this respect reference is made to the U.S. Pat. No. 4,843,748, U.S. Pat. No. 4,980,163 and U.S. Pat. No. 5,000,075.

Figure 5:
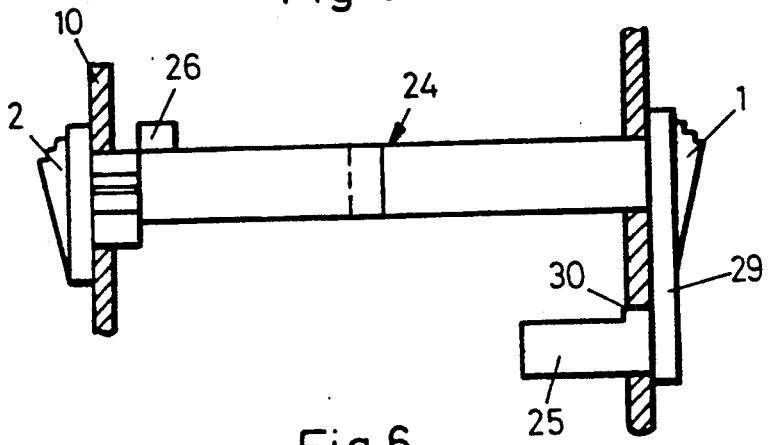
FIG. 5 is a view of an embodiment of the decocking-/safety control device in direction of the arrow A of FIG. 2.
Figure 6:
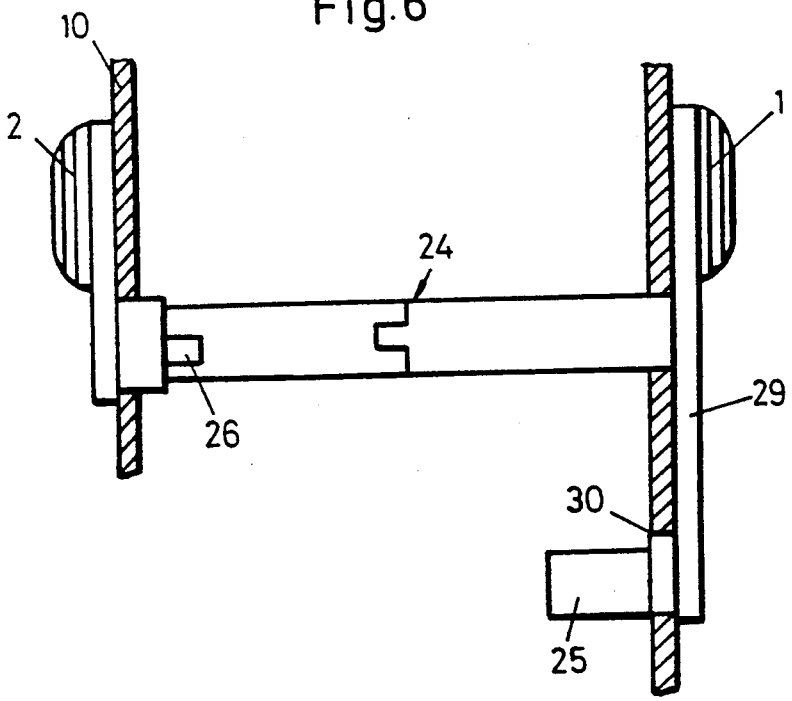
FIG. 6 is a view of the decocking/safety control device in direction of the arrow B of FIG. 2.

Reference is now made to FIGS. 5 and 6 illustrating the decocking/safety control device on a somewhat enlarged scale. FIG. 5 is a view of the device in the direction of the arrow A of FIG. 2. The control device shaft member 24 is rotatably supported in the frame 10 of the gun. It carries at the outside of the frame 10 a right-hand operating lever 1 and a left-hand operating lever 2. Accordingly, it must be noted that this device is suitable for left-handed and right-handed persons or, can be operated at the right-hand side or at the left-hand side of the gun, which reduces the possibilities of faulty operations. It can be seen from FIG. 5 and also from FIG. 6 that the shaft member 24 is made of two parts which can be mounted from the right-hand side and from the left-hand side through the frame 10 and connected therewithin by any known structuring. The shaft member 24 carries at its right side at the outer side of the frame 1 an arm 29. This arm 29 supports in turn a peg shaped first control member 25 projecting through the curvilinear slot 30 (FIG. 3) into the interior of the frame 10. At its left side the shaft member 24 supports a projection 26 which is the second control member.

Figure 7:
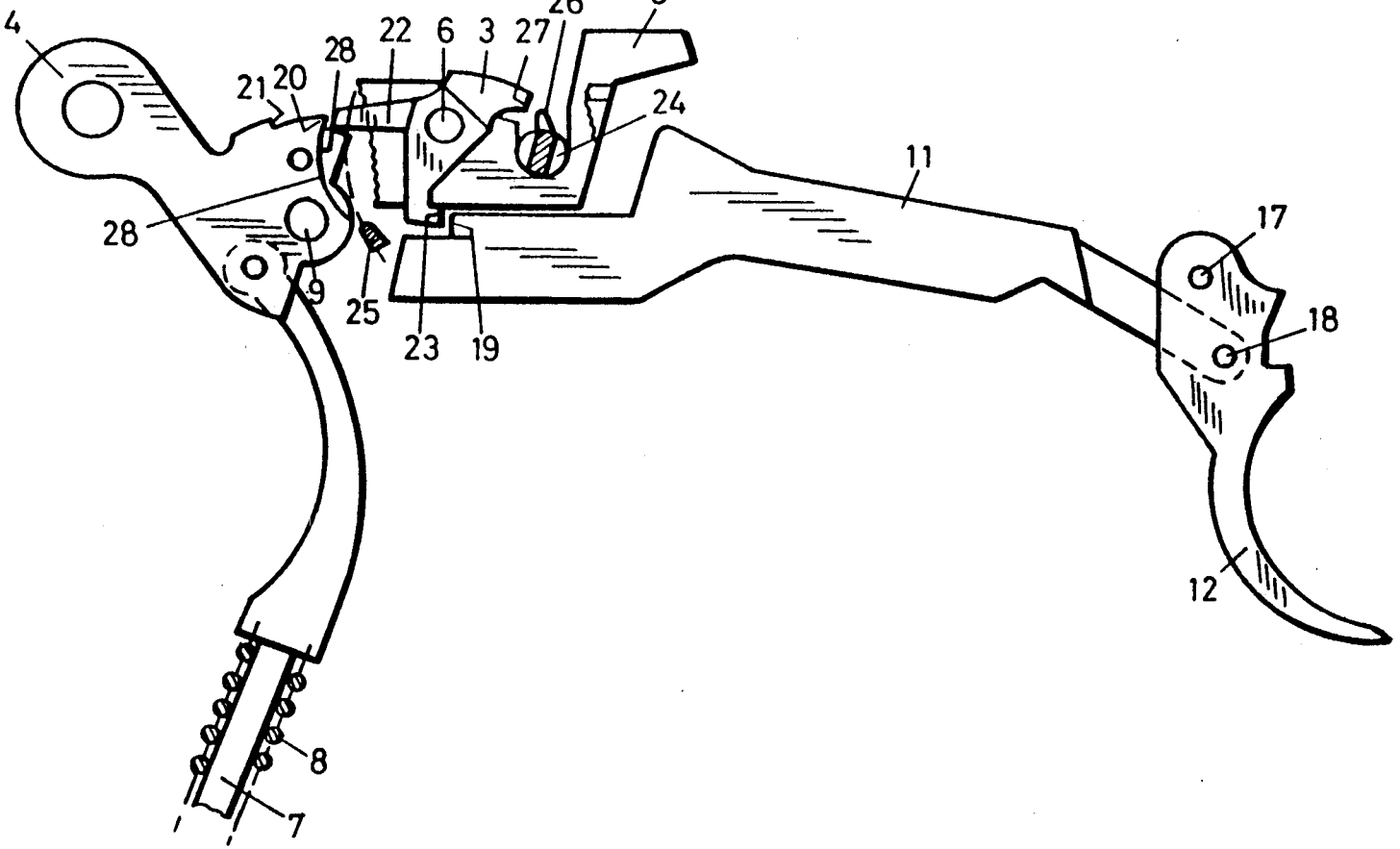
FIG. 7 is a schematic side view of the main operating parts of the semiautomatic pistol at their firing position.
Figure 8:
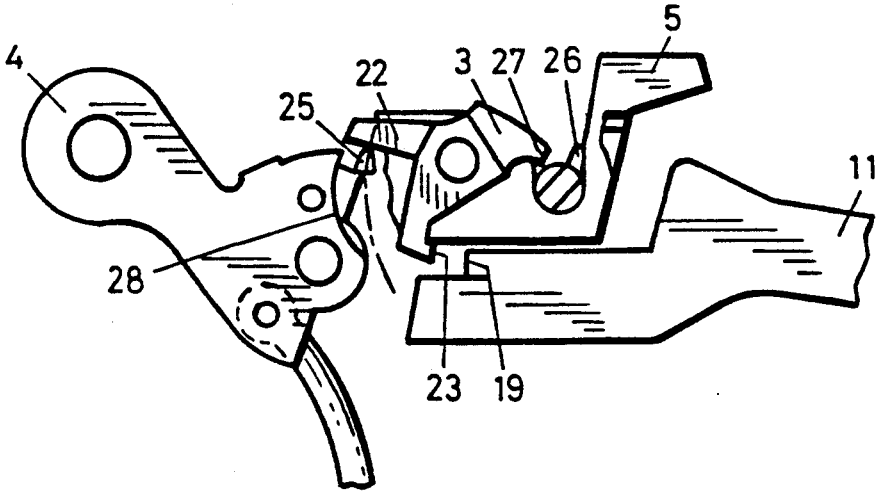
FIG. 8 is a side view of the main operating parts in their decocking position.
Figure 9:
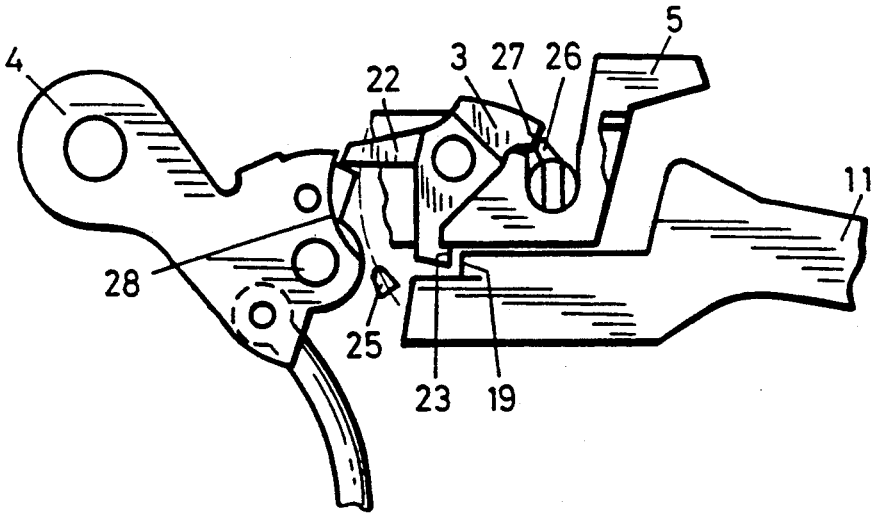
FIG. 9 is a side view of the main operating parts in their safety position.

Accordingly, when e.g. the operating lever member 1 is depressed, the shaft member 24 is caused to rotate such that the second control member 26 will also rotate around the axis of the shaft member 24. The first control member 25 will move upwards along a circular line around the center axis of the shaft member 24. Reference is made now to FIGS. 7-9 illustrating the main operating parts more in detail, whereby initially FIG. 7 will now be described.

The trigger 12 is pivotally mounted to the frame by the trigger pin 17. The trigger rod member 11 (which, as generally known, can be a frame or bracket like structure) is pivotally connected to the trigger 12 by means of the pin 18. At its opposite side the trigger rod member 11 includes a control surface 19.

The spring loaded sear 3 is pivotally mounted upon the frame 10 by means of the sear pin 6. The sear 3 includes specifically a tang 22, a control projection 23 located opposite the control surface 19 of the trigger rod 11, and an abutment stop 27.

Reference numeral 5 identifies the ejector.

The hammer 4 is pivotally mounted to the frame by means of the hammer pin 9. This hammer 4 includes a searing surface 20 located opposite the tang 22 of the sear 3 and, furthermore, a half-cocked notch 21 located somewhat behind the searing surface 20. The hammer 4 includes, furthermore, contiguous with the searing surface 20 a decocking control cam surface 28.

The decocking/safety control device is illustrated in FIGS. 7-9 merely by its shaft member 24, the first control member 25 and the second control member 26. When the shaft 24 is rotated, the first control member 25 moves along the dash-dotted curvilinear line illustrated in FIG. 7.

The decocking/safety control device, i.e. specifically the operating levers 1, 2, can be rotated between an upper, a center and a lower position. The upper position is the safety position. In this position the gun is cocked and locked. The trigger 12 cannot be pulled; the structural members causing the firing of the gun are blocked. The center position is the firing position. The gun is ready for firing and either in the single action mode or in the double action mode. The lower position is the decocking position. In this position the hammer is automatically decocked without the need of the operator contacting, i.e. moving the trigger. The operating levers 1, 2 move thereafter back into the center position.

The operation of this gun proceeds as follows. In order to initially load a round into the chamber the slide 13 is manually pulled back. The slide 13 moving backwards causes the hammer 4 to rotate counterclockwise around the hammer pin 9 into the position "cocked". In this position the hammer 4, biassed by the hammer spring 8, rests at its searing surface 20 against the tang 22 of the sear. The recoil spring 14 causes the slide 13 to move again forward into its original position and simultaneously a round is loaded from the magazine into the chamber of the barrel 15. The gun is now cocked, ready for firing and unlocked (safety off). The decocking-/safety control device is in its center position. This state of the operational members is illustrated in FIG. 7.

In order to fire the gun the trigger 12 is pulled such that the trigger rod 11 is pushed towards the left. The control surface 19 of the trigger rod 11 contacts the control projection 23 of the sear 3 causing the sear 3 to rotate clockwise around the sear pin 6. Accordingly, the tang 22 pivots upwards and off the searing surface 20 of the hammer 4. The hammer 4 biassed by the hammer spring 8 acting onto the hammer rod 7 rotates clockwise around the hammer pin 9 and strikes the firing pin 16 which in turn strikes the end of the chambered round. A shot is fired and the gas pressure causes the slide 13 to recoil backwards, causing the hammer 4 to be cocked again and a loading of the next round into the chamber.

If now the gun is carried in its cocked modus, it is now possible by operating the decocking/safety control device to lock the gun against an unintended, accidental firing by the following operation:

The operating levers 1, 2 are pivoted upwards into the position "safety". This can be performed either by means of the left hand or the right hand, because at both sides of the frame an operating lever 1 and 2, respectively, is accessible. When moving the operating lever upwards, the second control member 26 rotates counterclockwise and under the abutment stop 27 of the sear 3. This state is illustrated in FIG. 9. Quite obviously, when the control surface 19 of the trigger rod 11 is urged against the control projection 23 of the sear 3, the sear cannot rotate clockwise because the second control member 26 blocks the sear 3. Accordingly, the tang 22 of the sear 3 cannot rotate away from the searing surface 20 of the hammer 4. Thus, the hammer 4 is also blocked. It can impossibly pivot around the hammer pin 9 to strike the firing pin 16. It is impossible to fire the gun, the gun is locked.

Next, the decocking will be described. The procedure proceeds from the cocked state of the gun. The tang 22 of the sear 3 rests against the searing surface 20 of the hammer 4. The gun is thereby either locked (safety on), whereby the operating levers 1 and 2, respectively, are in the uppermost position or then unlocked and ready for firing, whereby the operating levers are in their center position.

The task is now to decock the hammer 4 without touching or operating the hammer 4 or the trigger 12. The operating levers 1, 2 are pivoted downwards into the lower position "decocked". The first control member 25, see FIG. 8, rotates around the center axis of the shaft 24 of the decocking/safety control device. It is hereby to be noted, that this control member 25, i.e. the peg, can be located at the left-hand side or at the right-hand side of the decocking/safety control device or even at both sides thereof, based on the illustration of FIGS. 5 and 6. Further, it is also possible to support the two levers 1, 2 on the hammer pin.

When depressing the operating levers 1, 2, the first control member 25 pivots upwards to contact the lower surface of the tang 22 of the sear 3 and accordingly rotates it upwards, such as illustrated in FIG. 8. The tang 22 leaves accordingly the searing surface 20 of the hammer 4 and the hammer begins to rotate clockwise around the hammer pin 9 due to the biassing force of the hammer spring 8. Simultaneously, the first control member 25 comes to contact and rest against the decocking control cam surface 28 of the hammer 4 because this control cam surface 28 moves towards the first control member 25 due to mentioned pivoting movement of the hammer 4. Accordingly, the control member 25 breaks and decelerates the pivoting movement of the hammer 4 in the clockwise direction and under the influence of the force exerted by the hammer 4 via the cam surface 28 slides slowly down the decocking control cam surface 28. The decocking/safety control device pivots into its center position (firing position). At the same time the sear 3 is caused to rotate by its biassing spring back around the sear pin 6, such that its tang comes to contact the half-cocked notch 21 of the hammer 4. Thus, the hammer cannot strike upon the firing pin 16 such that the gun cannot be fired.

In summarizing, when the hammer 4 is cocked, the operator can push the operating lever from its center position (firing position) upwards and lock the gun. The hammer 4 remains cocked (single action position), the sear 3, of which the tang 22 rests against the searing surface 20 of the hammer 4, is blocked. The trigger 12 cannot be pulled, because the trigger rod 11 cannot rotate the blocked sear 3. The gun is on safety and is cocked.

If the operating lever is pushed down into its center position, the gun is ready for firing. It can thereby be fired in the single action mode.

If the operating lever is pushed down into its lowermost position, the hammer 4 is automatically decocked. It is stopped by contact between the tang 22 of the sear 3 and the half-cocked notch 21 of the hammer 4.

While there is shown and described a present preferred embodiment of the invention, it is to be distinctly understood that the invention is not limited thereto, but may be otherwise variously embodied and practiced within the scope of the following claims.

We claim:

1. A handgun, having a frame, a firing pin, a barrel mounted thereupon, a slide for sliding reciprocating movement on said frame, a trigger pivotally mounted upon the frame by a trigger pin, a trigger rod member pivotally connected to the trigger by means of a pin and having a control surface, a spring loaded sear pivotally mounted upon the frame by means of a sear pin, a hammer pivotally mounted to the frame by means of a hammer pin, a hammer spring acting onto the hammer for causing movement of said hammer along a path for firing the gun, which hammer includes a searing surface and a half-cocked notch, which sear includes a tang for engaging the searing surface of the hammer, and includes a control projection for engaging the control surface of the trigger rod member, which sear is rotatable between a hammer locking position and a hammer release position, comprising a pivotable decocking/safety control device supported at the frame by means of a control device shaft member and having a first control member for cooperating with the sear and the hammer for causing said tang to engage said half-cocked notch for first initiating and then preventing movement of said hammer along said path for a decocking of the gun, and a second control member for cooperating with the sear for locking the gun.

2. The handgun of claim 1, in which the first control member is arranged for a movement into and out of contact with the tang of the sear, which sear includes further an abutment stop for engaging the second control member of the decocking safety control device, which decocking/safety control device is rotatable between a safety position, a firing position and a decocking position; whereby in the safety position of the decocking/safety control device its second control member contacts the abutment stop of the sear in its hammer locking position and prevents a movement thereof into its hammer release position; in the firing position of the decocking/safety control device its second control member is at a distance from the abutment stop of the sear allowing a trigger rod member initiated movement thereof into the hammer release position; in the decocking position of the decocking/safety control device its second control member is at a distance from the abutment stop of the sear and its first control member contacts the tang of the sear to urge it away from the path of movement of the searing surface of the hammer and into the path of movement of the half-cock notch of the hammer preventing the latter from snapping against the firing pin.

3. The handgun of claim 2, in which the hammer includes a decocking control cam surface located adjacent its searing surface in such a manner that the first control member of the decocking/safety control device in its decocking position contacts the decocking control cam surface, whereby the hammer spring initiated movement of the hammer towards its decocked position forces the first control member to move along the decocking control surface and thus to return the decocking/safety control device into its firing position.

4. The handgun of claim 3, in which the decocking control cam surface is a concavely extending surface area of the hammer and is frictionally engaged by the first control member of the decocking/safety control device, and in which the spring force of the hammer spring, the curvature of the decocking control cam surface and the coefficient of friction between the decocking control cam surface and the first control member are selected in such a manner that the decocking movement of the hammer proceeds at a controlled slow speed allowing the tang of the sear to safely engage the half-cocked notch of the hammer.

5. The handgun of claim 4, in which the decocking-/safety control device comprises a shaft member supported for rotation in the frame and mounted at both its ends to a respective operating lever member arranged at the respective outer side of the frame, further in which the second control member is a projection located on the shaft member, and in which one (1) of the operating lever members includes an arm extending along the outer side of the frame and supporting the peg shaped first control member projecting through a curvilinear slot in the frame into its interior.

* * * * *